US009488316B2

(12) United States Patent
Wu et al.

(10) Patent No.: US 9,488,316 B2
(45) Date of Patent: Nov. 8, 2016

(54) METHOD, SYSTEM AND DEVICE FOR REDUCING FRICTION OF VISCOUS FLUID FLOWING IN A CONDUIT

(71) Applicant: COMMONWEALTH SCIENTIFIC AND INDUSTRIAL RESEARCH ORGANISATION, Campbell (AU)

(72) Inventors: Jie Wu, Highett (AU); Lachlan Graham, Highett (AU); John Farrow, Waterford (AU); Bon Nguyen, Highett (AU)

(73) Assignee: COMMONWEALTH SCIENTIFIC AND INDUSTRIAL RESEARCH ORGANISATION, Australian Capital Territory (AU)

( * ) Notice: Subject to any disclaimer, the term of this patent is extended or adjusted under 35 U.S.C. 154(b) by 0 days.

(21) Appl. No.: 14/316,205

(22) Filed: Jun. 26, 2014

(65) Prior Publication Data

US 2014/0305509 A1 Oct. 16, 2014

Related U.S. Application Data

(63) Continuation of application No. 13/504,078, filed as application No. PCT/AU2010/001429 on Oct. 26, 2010, now abandoned.

(30) Foreign Application Priority Data

Oct. 26, 2009 (AU) ..... 2009905222

(51) Int. Cl.

| | |
|---|---|
| ***B65G 53/00*** | (2006.01) |
| ***F17D 1/16*** | (2006.01) |
| ***F17D 1/17*** | (2006.01) |

(52) U.S. Cl.

CPC . *F17D 1/16* (2013.01); *F17D 1/17* (2013.01); *Y10T 137/0391* (2015.04); *Y10T 137/206* (2015.04)

(58) Field of Classification Search

CPC .... B65G 53/18; B65G 53/521; B65G 53/22; Y10S 138/06

USPC ..... 406/89, 46, 47, 48, 90, 91, 197; 137/13, 137/806, 807; 138/114

See application file for complete search history.

(56) References Cited

U.S. PATENT DOCUMENTS

| | | | | |
|---|---|---|---|---|
| 759,374 | A * | 5/1904 | Isaacs | 137/13 |
| 2,821,205 | A | 1/1958 | Chilton et al. | |

(Continued)

FOREIGN PATENT DOCUMENTS

| | | |
|---|---|---|
| CN | 101275710 | 10/2008 |
| WO | 2006064014 | 6/2006 |
| WO | 2008058100 | 5/2008 |

OTHER PUBLICATIONS

International Search Report for PCT/AU2010/001429, Completed by the Australian Patent Office on Dec. 22, 2010, 3 Pages.

(Continued)

*Primary Examiner* — Joseph Dillon, Jr.
(74) *Attorney, Agent, or Firm* — Brooks Kushman P.C.

(57) ABSTRACT

There is disclosed a device for improving flow of a viscous fluid in a fluid transport conduit, the device comprising: a porous conduit having a passage through which the viscous fluid may pass between upstream and downstream sections of the fluid transport conduit; and a casing member having a wall which extends around the porous conduit, the device being configured such that, when it is in situ, a fluid transfer chamber having at least one fluid inlet is defined between the casing member wall and porous conduit, whereby lubricating fluid may pass under pressure through the inlet(s) into the fluid transfer chamber and through the porous conduit into the passage to lubricate the flow.

15 Claims, 5 Drawing Sheets

(56) References Cited

U.S. PATENT DOCUMENTS 3,040,760 A 6/1962 Macks
3,307,567 A 3/1967 Gogarty et al.
3,604,758 A 9/1971 Flain et al.
3,892,252 A 7/1975 Poettmann
3,937,283 A * 2/1976 Blauer et al. ..... 166/307
4,007,694 A * 2/1977 Fowler et al. ..... 108/55.1
4,083,607 A 4/1978 Mott
4,116,491 A 9/1978 Ply
4,502,868 A * 3/1985 Yaghmaie et al. ..... 44/280
4,510,958 A * 4/1985 Coursen ..... E21B 43/26 137/13
4,552,568 A * 11/1985 Igarashi et al. ..... 44/280
4,655,943 A * 4/1987 Elmquist et al. ..... 507/226
4,722,363 A * 2/1988 Allyn ..... G05D 11/006 137/13
4,745,937 A * 5/1988 Zagustin ..... F15D 1/06 137/13
4,775,267 A 10/1988 Yamamoto
5,027,843 A * 7/1991 Grabois ..... C09K 8/68 137/13
5,165,440 A * 11/1992 Johnston ..... B29B 7/32 137/13
5,169,267 A * 12/1992 Cowper ..... 406/49
5,173,007 A * 12/1992 Krajieck ..... B01F 5/0256 137/13
5,220,938 A * 6/1993 Kley ..... F17D 1/16 137/13
5,361,797 A 11/1994 Crow et al.
5,479,957 A 1/1996 Crow et al.
5,562,366 A 10/1996 Paulson
5,605,174 A 2/1997 Schlecht et al.
5,722,802 A * 3/1998 March ..... 406/46
5,983,915 A * 11/1999 Rojey ..... C09K 3/00 137/13
6,227,768 B1 5/2001 Higuchi et al.
6,458,292 B1 * 10/2002 Lin et al. ..... 252/180
6,536,426 B1 3/2003 Nilsson et al.
6,719,500 B2 * 4/2004 Pfeiffer ..... B65G 53/58 406/91
6,837,775 B2 1/2005 Anand et al.
7,442,121 B2 * 10/2008 Cassidy ..... F24F 13/0218 138/113
7,833,955 B2 11/2010 Burrington et al.
8,215,028 B2 * 7/2012 Eia ..... 34/60
8,342,198 B2 * 1/2013 Asomaning ..... C10M 145/20 137/13
8,596,931 B2 * 12/2013 Nagashima et al. ..... 406/197
8,678,200 B2 * 3/2014 Hodges et al. ..... 210/456
2002/0085886 A1 * 7/2002 Dibble et al. ..... 406/197
2006/0013659 A1 * 1/2006 Pfeiffer ..... B65G 53/14 406/106
2007/0212175 A1 * 9/2007 Ernst ..... B65G 53/58 406/108
2008/0031697 A1 2/2008 Berggren
2009/0133756 A1 * 5/2009 Peysson ..... C25B 9/08 137/13
2014/0119841 A1 * 5/2014 Purcell et al. ..... 406/47
2014/0360587 A1 * 12/2014 Wu ..... F17D 1/16 137/13

OTHER PUBLICATIONS

Nigel., Hydraulic Conveying Association of South Africa, 4th One Day Seminar on Hydraulic Transport in the Mining Industry, Apr. 7, 2003, Indaba Conference Centre, 12 pages, "How to Reduce Pipe Friction in Slurry Flows."

* cited by examiner

METHOD, SYSTEM AND DEVICE FOR REDUCING FRICTION OF VISCOUS FLUID FLOWING IN A CONDUIT

CROSS-REFERENCE TO RELATED APPLICATIONS

This application is a continuation of U.S. National Phase application Ser. No. 13/504,078, filed Jun. 26, 2012, which claims priority to PCT Appln. No. PCT/AU2010/001429 filed on Oct. 26, 2010, which claims priority to AU Patent Appln. No. 2009905222 filed on Oct. 26, 2009, the disclosures of which are hereby incorporated in their entirety by reference herein.

TECHNICAL FIELD

Described embodiments relate generally to methods, systems, and devices for reducing friction of viscous fluid flowing in a conduit. Described embodiments relate generally to methods, systems, and devices for reducing friction of viscous fluid flowing in a conduit.

BACKGROUND

Thickened slurry materials are increasingly being handled in mining and mineral processing industries, providing benefits of reduced water consumption, reduced impact to the environment, and benefits for turn-down and re-start of pipelines conveying viscous slurries. High viscosity materials are also widely used in the other industries, such as oil industries (pumping heavy crude oil), power industries (pumping fly ash) and polymer industries.

Due to increased friction loss with high viscosities, excessively high pressure and power are often used for conveying viscous materials. Sometimes the pressure required is so high that it makes the capital cost for the pumping equipment and the operating energy cost unacceptably high.

It is desired to address or ameliorate one or more shortcomings or disadvantages associated with prior techniques for transporting viscous fluids or slurries or to at least provide a useful alternative thereto.

SUMMARY

According to a first aspect of the present invention, there is provided a device for improving flow of a viscous fluid in a fluid transport conduit, the device comprising:

- a porous conduit having a passage through which the viscous fluid may pass between upstream and downstream sections of the fluid transport conduit; and
- a casing member having a wall which extends around the porous conduit,
- the device being configured such that, when it is in situ, a fluid transfer chamber having at least one fluid inlet is defined between the casing member wall and porous conduit, whereby lubricating fluid may pass under pressure through the inlet(s) into the fluid transfer chamber and through the porous conduit into the passage to lubricate the flow.

In a preferred embodiment of the invention, the device is separately formed from the fluid transport conduit and is configured to be mounted thereto. In other embodiments, the device may be formed integrally with the fluid transport conduit.

In a preferred embodiment of the invention, the casing member is defined by a sleeve.

Preferably, the porosity of the porous conduit is such that the lubricating fluid is distributed substantially evenly around the passage.

Preferably, the passage is arranged to be concentric with interiors of the upstream and downstream sections adjacent thereto. Preferably, the passage is of a diameter which is substantially the same as diameters of said interiors.

In a preferred embodiment of the invention, the porous conduit is formed of a sintered material. In one embodiment, the porous conduit is formed of sintered bronze and has an average pore size of 2 to 500 microns such that it has a voidage of 20% to 50%. In another embodiment of the invention, the porous conduit is formed of sintered stainless steel and has an average pore size of 0.2 to 100 microns such that it has a voidage of 20% to 50%.

Preferably, the or each inlet is formed through said wall.

In a preferred embodiment of the invention, the device further comprises a flange arranged at at least one end of the casing member for connection to a mating flange on a said section to couple the device to the section. The or each mating flange may define an end wall of the chamber. The or each flange of the device may instead couple the to another part of the fluid transport conduit.

The device may further comprise at least one filter arranged to filter the lubricating fluid before it passes into the porous conduit. The or each filter may be porous and have a smaller pore size than the porous conduit. In one embodiment, the or each filter is arranged at a said inlet. In another embodiment, the or each filter is disposed in the fluid transfer chamber, or upstream of the fluid inlet.

Preferably, the device is configured such that the lubricating fluid may be liquid.

According to a second aspect of the present invention, there is provided an assembly comprising said fluid transport conduit and a device as defined above in situ.

According to a third aspect of the present invention, there is provided an assembly according to the second aspect, wherein:

- the viscous fluid is flowing through said fluid transport conduit; and
- the lubricating fluid is passing under pressure from the fluid inlet(s) into the fluid transfer chamber and through the porous conduit into the passage to lubricate the flow.

Preferably, the lubricating fluid is liquid: In a preferred embodiment of the invention, the liquid comprises water. Preferably, the water incorporates a viscosity modifier.

In an alternative embodiment of the invention, the lubricating fluid is gas.

In a preferred embodiment of the invention, the liquid forms a barrier which lines an inner wall of the fluid transport conduit to inhibit corrosion or scaling.

In a preferred embodiment of the invention, the assembly further comprises at least one further said device in situ and the devices are arranged at spaced positions along the conduit.

Preferably, the viscous fluid comprises slurry.

According to a fourth aspect of the present invention, there is provided a fluid transport system comprising an assembly as defined above and a pump coupled to the fluid transport conduit and arranged to effect the flow of the viscous fluid. The device may be positioned upstream or downstream of the pump.

According to a fifth aspect of the present invention, there is provided a method for improving flow of a viscous fluid in a fluid transport conduit, the method comprising, at at least one position along the conduit, effecting flow of lubricating fluid under pressure from a fluid transfer chamber, through a porous conduit surrounded by the chamber and arranged between upstream and downstream sections of the fluid transport conduit, such that the lubricating fluid passes through the porous conduit into a passage defined by the porous conduit through which the viscous fluid passes between the sections, thereby lubricating the flow.

Preferably, the lubricating fluid is distributed substantially evenly around the passage.

In a preferred embodiment of the invention, the lubricating fluid is filtered before it passes through the porous conduit.

In a preferred embodiment of the invention, said at least one position comprises a plurality of positions which are spaced apart along the fluid transport conduit.

Preferably, said wall and the porous conduit are substantially cylindrical and concentric.

Said wall may comprise at least two spaced fluid inlets for providing the lubricating fluid to the chamber. The lubricating fluid may have a viscosity which is less than a viscosity of the viscous fluid.

A preferred embodiment of the invention provides a system comprising a device as defined above and a pressure sensor and/or a flow sensor coupled to a conduit supplying the lubricating fluid to monitor fluid pressure and/or flow at the inlet(s). The system may comprise a plurality of said devices spaced apart and arranged in-line along the fluid transport conduit.

Further embodiments relate to a device, assembly, system or method as described above, where a pressure of the lubricating fluid and a porosity of the porous conduit are selected to provide the lubricating fluid into the passage so that the lubricating fluid constitutes between about 0.05% and about 10% of fluid flowing through the passage. More particularly, the lubricating fluid may constitute between about 0.05% and about 5% of fluid through the passage. More particularly still, the lubricating fluid may constitute between about 0.1% and about 2% of fluid through the passage.

BRIEF DESCRIPTION OF THE DRAWINGS

Embodiments are described in further detail below, by way of examples and with reference to the accompanying drawings, in which.

DETAILED DESCRIPTION

Described embodiments relate generally to methods, systems, and devices suitable for use in reducing friction of viscous fluid flowing in a conduit. In particular, embodiments involve providing a porous conduit in-line with the conduit Carrying the viscous fluid, where pressurised fluid is forced through the porous Conduit to effectively lubricate an inner surface of the porous conduit through which the viscous fluid travels. Although some intended applications are described, other applications, uses and/or benefits may be obtained from the described embodiments. Thus, the described devices, systems and methods are not intended to be limited to use in friction reduction.

Figure 1:
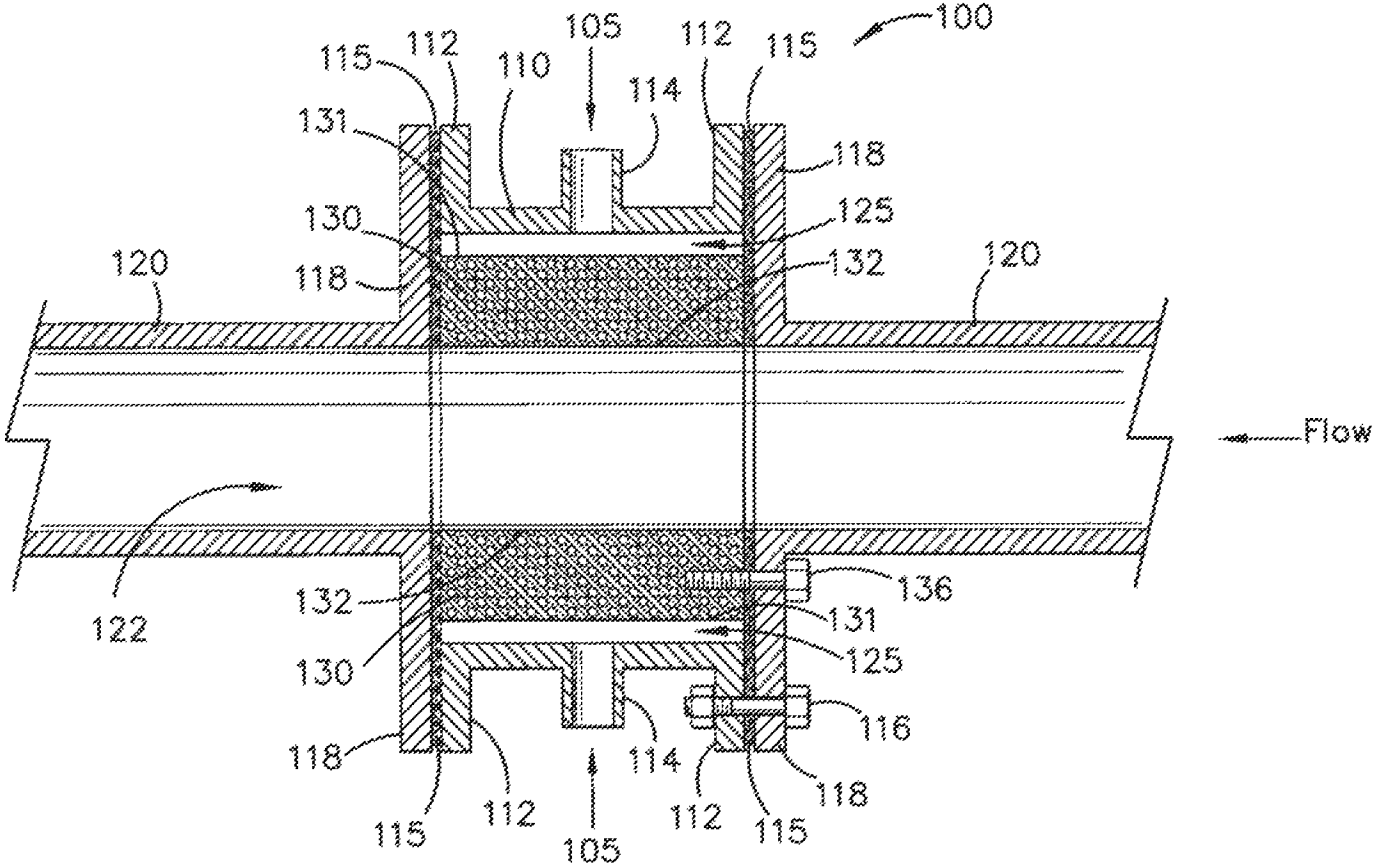
FIG. 1 is a cross-sectional schematic representation of a flow lubrication device according to some embodiments.
Figure 2:
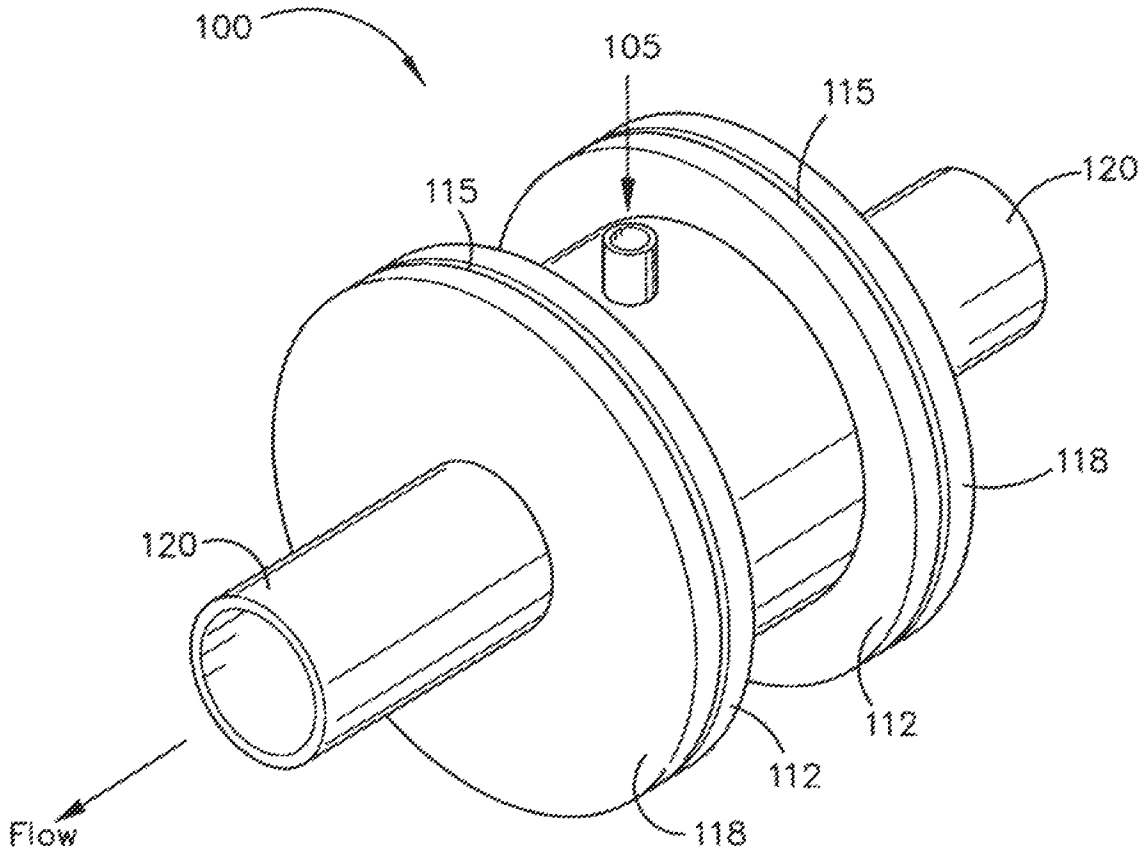
FIG. 2 is a perspective view of the device of FIG. 1.
Figure 3:
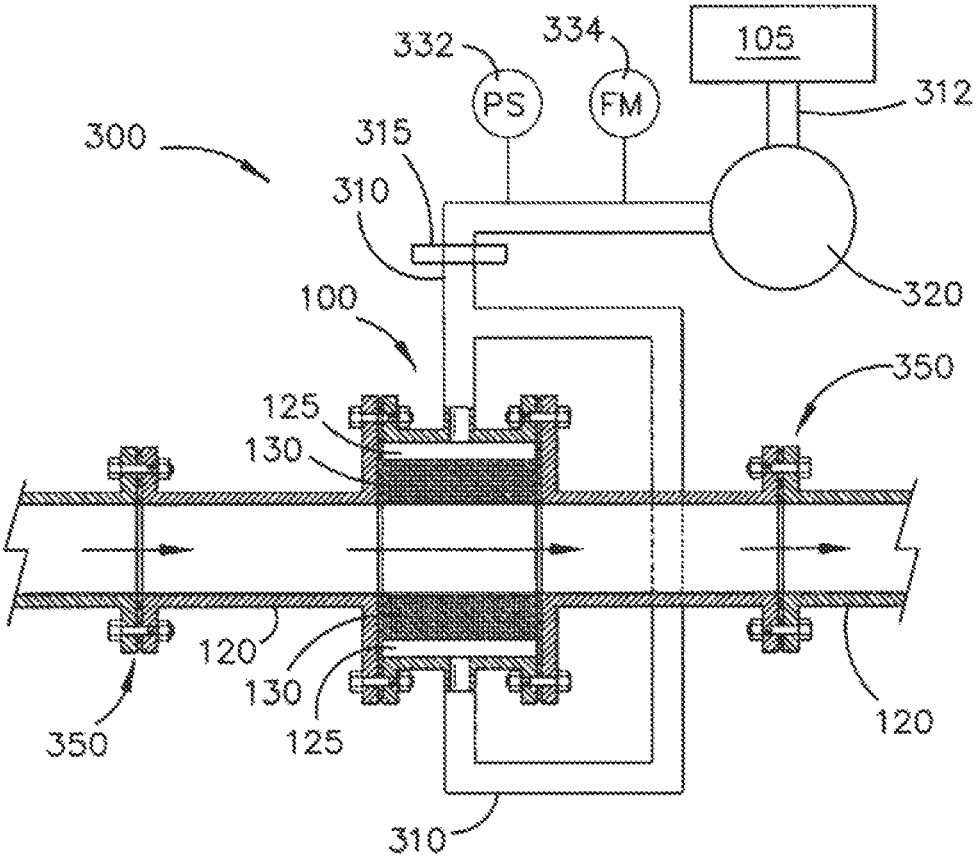
FIG. 3 is a schematic representation of a system comprising the device of FIG. 1, showing components of the device positioned in-line.

Referring firstly to FIGS. 1 to 3, a device 100 for reducing friction of viscous fluid in a fluid transport conduit is described. It is generally envisaged that device 100 will be positioned in-line, as part of a fluid transport conduit carrying viscous fluids, including slurries, pastes and other thickened fluids, exhibiting either non-Newtonian behaviour or Newtonian behaviour. For Newtonian fluids, the viscosity may be say 1-100 Pa s. For 20 non-Newtonian fluids, the fluids may be subjected to shear-thinning yield stress of say 10-100 Pa or higher, with the fluid viscosity varying with the shear rate over a wide range.

Figure 4:
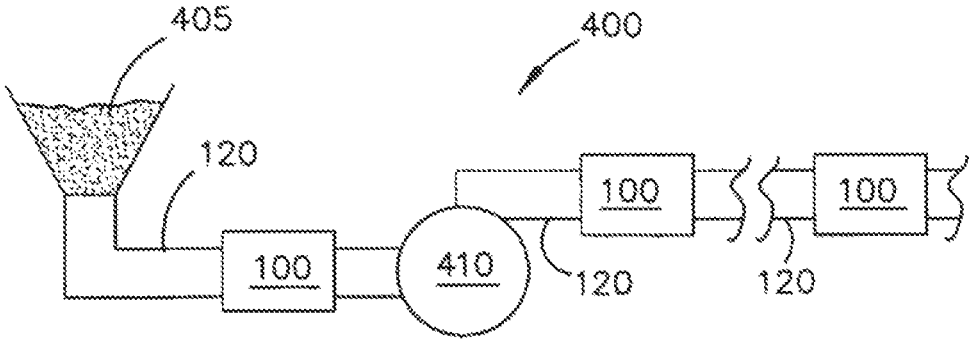
FIG. 4 is a schematic representation of a system Comprising one or more of the device of FIGS. 1 to 3 in-line in a fluid transport conduit.

As depicted in FIG. 4, more than one device 100 may be provided in-line in a fluid transport system, for example spaced at intervals along a length of the transport conduit and/or positioned at the inlet and/or outlet sides of a pump 410.

Device 100 comprises casing member in the form of an outer sleeve 110 of a generally cylindrical fluid-impermeable form having opposed end flanges 112. The outer sleeve t 10 has at least one fluid inlet portion 114 positioned intermediate the end flanges 112 and defining a fluid inlet for receiving pressurised fluid 105. End flanges 112 are coupled to respective coupling flanges 118 by a suitable coupling means, such as a plurality of bolts 116. An annular gasket 115 may be positioned intermediate each end flange 112 and the adjacent flange 118 for sealing purposes. Each flange 118 is attached, coupled to or integrally formed with a wall of a conduit 120 that defines a passage 122 through which the viscous fluid flows between upstream and downstream sections of a fluid transport conduit. Positioned within the outer sleeve 110 and bounded at each end by the gaskets 115 is a porous conduit 130 which is configured for receipt around a region of space between the respective upstream and downstream sections of the fluid transport conduit. The porous conduit 130 is formed generally as a hollow cylinder that defines a passage that is coextensive with passage 122 and gaskets 115. The diameter of the passage defined by conduit 120, gaskets 115 and porous conduit 130 is substantially constant, at least in the vicinity of device 100. Porous conduit 130 may be fixed in position by a suitable positioning means, which may comprise a number of fixing bolts 136 passing through flange 118, gasket 115 and into part of porous conduit 130, for example.

The diameter and thickness of porous conduit 130 is selected so that there is a gap of annular cross-section between an outer surface 131 of porous conduit 130 and an inner surface of outer sleeve 110. This gap acts as a fluid transfer chamber 125 for pressurized fluid 105 received through fluid inlet portion 114. In situ, the fluid transfer chamber 125 is sealed so that the only egress for pressurised fluid from fluid inlet 114 is through the wall of porous conduit 130. Outer sleeve 110 may be configured to fully encase the fluid transfer chamber or, alternatively, the upstream and downstream sections of the fluid transport conduit may also form part of the fluid transfer chamber. Porous conduit 130 is formed to have a generally even porosity so that pressurised fluid in fluid transfer chamber 125 can travel through the porous material of the porous conduit 130 and provide a generally evenly distributed amount of fluid at a cylindrical inner surface 132 of the fluid conduit 130. This relatively even distribution of the pressurised fluid over all or most of the inner surface 132 effectively provides a thin lubricating layer of fluid to decrease the pressure of the viscous fluid as it travels through the porous conduit 130 in the direction of flow. To achieve this, the pressure drop across the porous conduit 130 from its outer surface 131 to its inner surface 132 is substantially greater, for example by orders of magnitude, than the pressure drop between the fluid inlet and the outer wall 131. The pressure drop between outer surface 131 and inner surface 132 may be about 1 to 6 bars, for example, for a porous conduit 130 formed of sintered brass. If water is used as the pressurised fluid, an injection pressure of 10 kpa may be suitable for a slurry paste flowing at 1 kpa per meter pressure loss gradient.

Because Of the porous nature of porous conduit 130 and its selected (intentionally manufactured) even porosity, the porous conduit 130 provides effectively hundreds, thousands or millions of spaced locations (e.g. orders of magnitude of say 102 to 10 s) at which a small amount of the pressurised fluid can emerge at the cylindrical inner surface 132 of the porous conduit 130. The aggregate effect of these small fluid amounts is a relatively uniformly distributed or even film or layer of fluid being present along inner surface 132 to lubricate flow of the viscous fluid through the passage. The variation in thickness of the film may be in the order of 5%. The amount of fluid consumed in providing this film or layer is comparatively small when compared with previous attempts to lubricate a conduit.

Provision of this film or layer isolates the viscous fluid and reduces physical contact between the viscous fluid and the conduit to inhibit fouling and scaling or other chemical deposition. The lubricating liquid may also form a barrier which lines an inner wall of the fluid transport conduit to inhibit corrosion or scaling.

Provision of this film or layer may result in increased lubrication of the viscous fluid in conduit 120 for some distance downstream of the porous Conduit 130.

Porous conduit 130 may be formed of sintered materials, such as sintered metal, plastic, glass or ceramic materials. Alternatively, the desired porosity of porous conduit 130 may be achieved by other means, such as chemical or physical processes involving the use of certain reagents or physical effects such as gas bubbling or compression. Generally speaking, when the porous conduit is formed from a sintered metal, the average pore size is between 10 and 40 microns. The average pore size of the porous conduit 130 may be in the order of about 2 to 500 microns for sintered bronze materials (20%-50% voidage) or 0.2 to 100 microns (20% to 50% voidage) for sintered 316 stainless steel, for example. An optimised pore size to let free passage of fine solid particles suspended in the liquid is about 20 microns for a porous conduit made of stainless steel material. However, the optimal pore size for a given application will depend on the nature of the pressurised fluid to be passed through the porous conduit 130 and/or the desired flow rate of the pressurised fluid therethrough.

The material of the porous conduit 130 may be selected to have a coefficient of friction that is roughly the same as, or at least not varying substantially from, the coefficient of friction of the walls of conduit 120. The length of the porous conduit 130 (and device 100) in the longitudinal direction of fluid flow may be varied, depending on the diameter of the passage defined by conduit 120 and inner surface 132 of porous conduit 130. For example, the larger the passage diameter, the longer the length of porous conduit 130 that may be required to achieve the desired lubricating effect.

It is considered that flow rates of the injected pressurised fluid through porous conduit 130 of between about 20% and about 0.005% of the viscous fluid flow rate can be effective to reduce frictional pressure loss in conduit 120. Flow rates of between about 5% and about 0.05% or between about 2% and about 0.1% may be even more effective.

The pressurised fluid 105 (shown in FIG. 3) may comprise a gas, such as air, or liquid, such as water or a combination of gas and liquid. The pressurised fluid 105 may comprise, or be combined with, an additive substance that changes the properties to give the fluid a particular desired property or characteristic. For example, the additive substance may comprise a viscosity modifier. The pressurised fluid may comprise, or be combined with, more than one additive substance. The lubricating liquid may also comprise an anti-scale reagent, a corrosion inhibitor or another soluble or insoluble chemical reagent.

If water is used as the pressurised fluid, it may comprise a viscosity modifier or other additive substance to reduce the diffusiveness of the pressurised fluid in relation to the viscous fluid. Such viscosity modifiers may include polymer types such as olefin copolymers (OCP), dispersant styrene ester copolymers (DSE), polymethacrylates (PMA), radial hydrogenated isoprene (IR), styrene-hydrogenated isoprene (SI) and styrene-hydrogenated butadiene copolymers (SB), for example. Generally, while suitable polymers may be used as a viscosity modifier additive, other types of viscosity modifiers may be employed instead, where they would not be incompatible with the materials of the device or act contrary to the purpose of improving overall fluid transport in a conduit. Further, liquids other than water may be used, such as oil or a combination of oil, water or other fluid that has the effect of reducing the drag (friction) or viscosity of the slurry or other viscous fluid.

FIG. 2 illustrates the coupling of device 100 in line with fluid conduit 120. Flanges 112 and 118 may act as the means for coupling the device 100 in-line with the conduit 120. Further flanges or coupling means may be provided if desired or a different coupling means may be substituted for flanges 112 and 118. For example, as shown in FIG. 2, further flanged couplings 350 may be provided at the upstream and downstream ends of the conduit 120 on either side of device 100 to allow for greater ease of coupling device 100 into a pre-existing or newly constructed fluid transport line.

Referring further to FIG. 3, a system 300 comprising device 100 is illustrated, in which device 100 is shown coupled to pressurised fluid supply conduit 310 to provide the pressurised fluid 105 via a pressurisation device 320, such as a pump or compressor. System 300 may further comprise a filtration device 315 to filter fluid supplied to the fluid inlet 114 from the fluid supply conduit 310 and may further comprise a pressure sensor 332 and a flow meter 334 for monitoring the supply of the pressurised fluid 105. As part of system 300, pressurised fluid 105 is coupled to the pressurisation device 320 via a suitable conduit 312 or in a suitably direct manner. Pressurised fluid 105 may be contained in a suitable container defining a fluid reservoir. In some embodiments, the container containing the pressurised fluid may be-pre-pressurised, obviating the need for a separate pressurisation device 320.

Although not shown, pressure sensor 332 and flow meter 334 may be in communication with a central monitor system (not shown). This central monitoring system may provide control signals to pressurisation device 320, as appropriate, in order to appropriately pressurise fluid 105. Alternatively, a local controller (not shown) may be coupled to pressurisation device 320, pressure sensor 332 and flow meter 334 to regulate pressure and flow of the pressurised fluid 105 and to send alarms or status update signals to the central monitoring system, if appropriate.

Referring also to FIG. 4, a system 400 may comprise multiple devices 100 coupled inline with conduit 120 and a pump 410 for transporting a slurry 405 along the conduit 120. Particularly for non-Newtonian liquids or slurries 405, some pumps 410 may be ineffective to create sufficient vacuum to induce the slurry to move along the conduit 120. For example, centrifugal pumps can find it difficult or impossible to overcome frictional forces associated with flow of viscous fluids within the conduit 120, particularly where the centrifugal pump is not assisted by sufficient head of fluid. In some instances, device 100 (for example, as part of system 300) can be installed upstream of the pump 410 to lubricate the flow of viscous fluid in the conduit 120, thereby reducing the fluid pressure along at least part of the line and allowing effective operation of the pump 410.

As illustrated in FIG. 4, a device 100 may be located upstream of pump 410 or downstream thereof or both. Further, multiple devices 100 may be positioned in-line and spaced apart along-the fluid transport conduit 120 in order to facilitate transport of the viscous fluid over longer distances. What is considered to be a "longer distance" will depend on the specific application, including the type of viscous fluid to be transported and the diameter of conduit.

Figure 5:
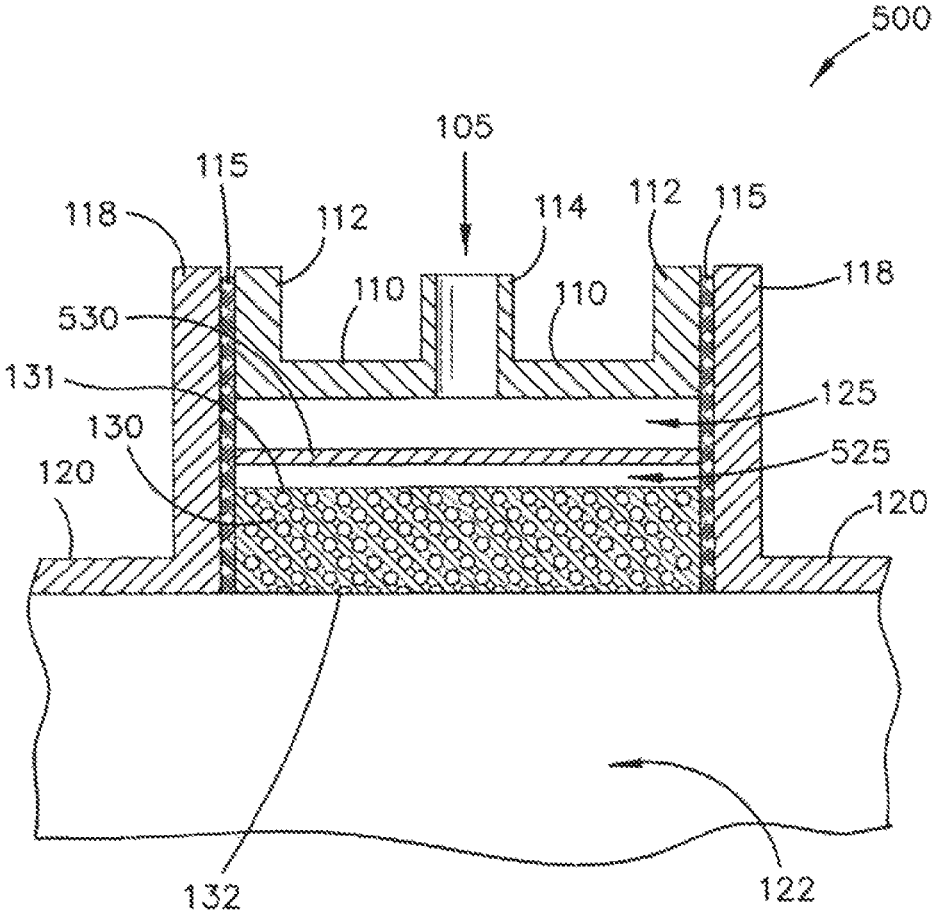
FIG. 5 is a partial cross-sectional diagram of a flow lubrication device according to further embodiments.

Referring now to FIG. 5, a variation of device 100 is shown and described and is designated generally by reference numeral 500. Device 500 may comprise exactly the same components as device 100 and be useable within system 300 in exactly the same manner as described above, the difference being that device 500 comprises a filtration layer or sleeve 530 disposed between the outer surface 131 of porous conduit 130 and the inner surface of outer sleeve 110. Filtration sleeve 530 is formed of a suitably porous material such as a fine cloth or other filtration materials having a smaller average pore Size than the average pore size of porous conduit 130 in order to filter particles from the pressurised fluid 105 that might cause blockage of some of the pores of porous conduit 130 which may result from solids lodging in the pores, bacteria growth or chemical deposition. The average pore size of filtration sleeve 530 may be in the order of about 0.5 to 1 micron, or in the order of about 1 to 5 micron, for example, where the pore size of the porous conduit 130 may be in the vicinity of 10 microns on average. Thus, on periodic maintenance, filtration sleeve 530 may be cleaned and/or replaced.

Filtration sleeve 530 may be disposed adjacent outer surface 131 of porous conduit 130 or spaced therefrom to create a second fluid transfer chamber 525 at a different pressure to the first fluid transfer chamber 125.

In the described embodiments, the pressure drop between the fluid inlet 114 and the inner surface 132 of the porous conduit may be about 1 bar to about 6 bars. Where a filtration sleeve 530 is employed, the total pressure drop may be greater than if the filtration sleeve 530 were absent.

Although not shown, a sand filtration system may, in the case of liquid being used as the pressurised fluid, also be used to filter fluid supplied to devices 100 or 500. The sand filtration system may be used in connection with, or as alternative to, filtration sleeve 530. The sand filtration system can also increase a pressure drop of a liquid flowing through the fluid transfer chamber 125, thereby providing better uniformity in fluid distribution around the passage.

In some embodiments, the pressurised fluid 105 may have a first viscosity less than a second viscosity of the viscous fluid flowing in passage 122. In other embodiments, providing that an appropriate lubrication function is achieved, the viscosity of the pressurised fluid may not necessarily be less than that of the viscous fluid flowing in passage 122.

While FIGS. 1 and 3 show device 100 having two fluid inlets 114, device 100 (and 500) is operable with 1, 3, 4 or more fluid inlets 114.

Experimental results were obtained to verify the lubricating (friction-reducing) "effect of the device 100, as compared to a fluid injection device having four distinct circumferentially positioned fluid injection points. The results of these tests are set out in the Tables 1 to 8 below. The results indicate that use of the described embodiment can achieve a substantial reduction in pressure difference across the length of the porous conduit providing a lubricating fluid flow, as compared to a conduit with no lubricating fluid flow.

The experimental set up involved use of an injection section at which the 4-hole device and device 100 were positioned in-line with a conduit having a diameter of about 0.05 m. A first pressure difference was measured across the injection section and a second pressure difference was measured across the downstream pipe section of 2 m in length. The upstream end of the downstream section was separated from the downstream end of the injection section by about 0.55 m. The separation of the pressure measurement points for the 4-hole device was about 0.77 m, while the separation of the pressure measurement points for the porous conduit device (device 100) was about 0.29 m at the injection section. The length of the injection section for device 100 was about 0.3 m (with the porous conduit being about 0.2 m in length), while the length of the injection section for the 4-hole device was about 0.7 m.

Figure 6:
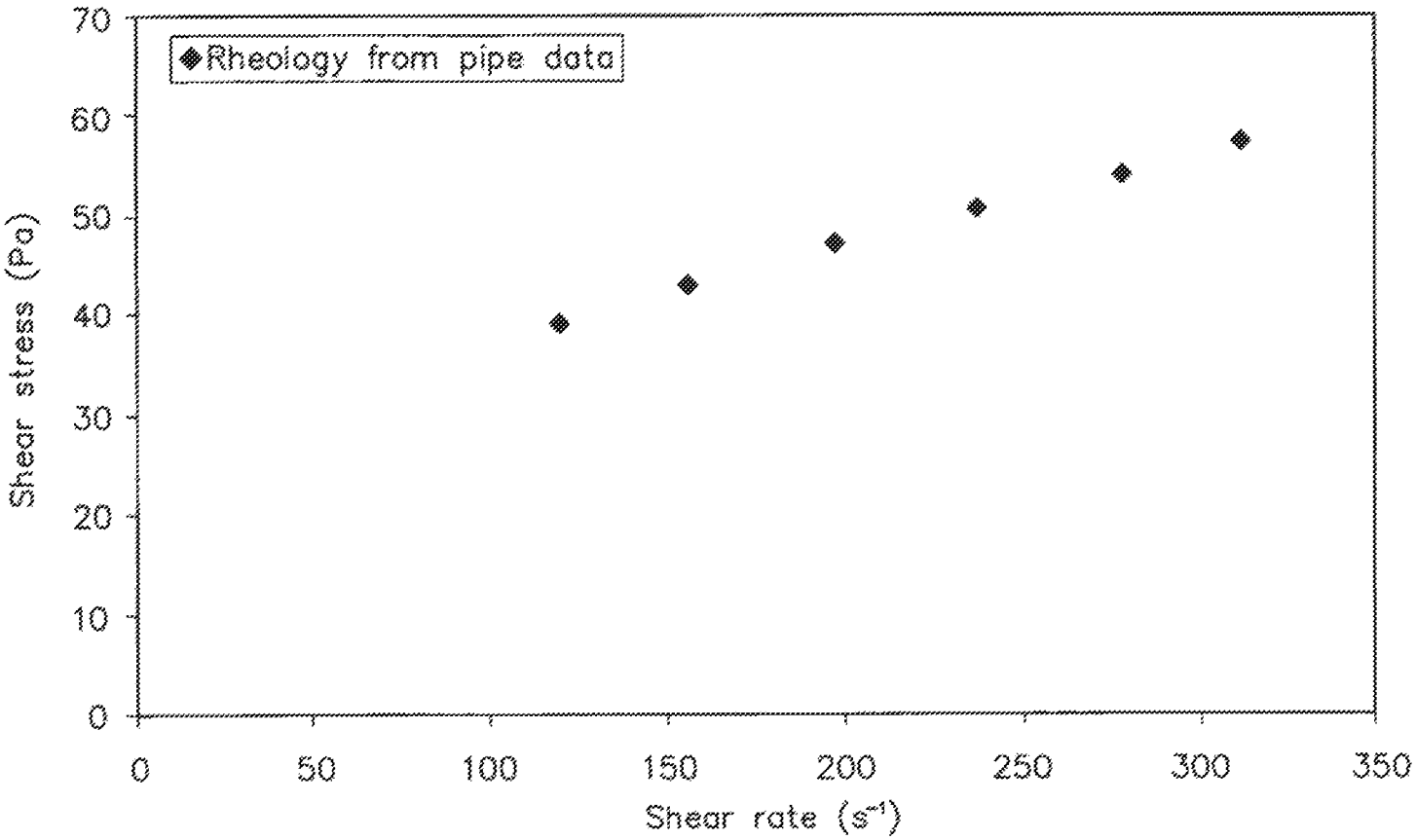
FIG. 6 is a plot of theology data of viscous fluid used in described experiments.

For the 4 point injection device, the holes through which the fluid was injected into the conduit were about 1 mm in diameter and were evenly circumferentially spaced around a circular line on the inside of the conduit. The viscous fluid used for the test was a clay slurry (bentonite). The rheology of the clay slurry used in the experiment of the test viscous fluid is plotted in FIG. 6. For the porous conduit, a series of de-oiled sintered bronze bearings placed end-to-end were used.

In the tables below U denotes, the flow velocity of the viscous fluid in the conduit, Q denotes the flow rate and DPDx denotes the pressure loss over a length x of the injection section or the downstream pipe section.

Tables 1 and 2 show that for the 4-hole device, some pressure reduction was achieved at only low fluid velocities in the injection section and there was some corresponding pressure reduction (over the case where no pressurised fluid was provided) in the downstream pipe section.

For the porous conduit (i.e. using the arrangement of device 100), three separate sets of test results were obtained for different flow velocities of the viscous fluid and different flow rates of both the viscous fluid and injected pressurised fluid. The results for the first test are shown in Tables 3 and 4, the results for the second test are shown in Tables 5 and 6 and the results for the third test are shown in Tables 7 and 8. All of these results demonstrate a useful non-zero pressure reduction in both the injection section and downstream pipe sections when the pressurised lubricating fluid is injected through the porous conduit. In some cases, the pressure reduction is substantial.

The test results show that, in general, pressure loss reduction can be achieved by injecting fluids (i.e. water in these tests) into a flowing, viscous material. A significantly higher pressure loss reduction was achieved by using the porous medium as against a conventional injection method, such as the 4-point injection device used here. It can be seen that for a small amount of injected water flow of 0.5-1% of the slurry flow, a 30-50% reduction in pressure loss was achieved. It can be seen that the pressure reduction value decreases with increasing flow velocity (U m/s), due to an increased diffusion effect at higher fluid velocities.

TABLE 1

4-Hole Injection Results - Injection Section

| U (m/s) | Qslurry (L/min) | Q lube (L/min) | % lube flow | DPDx no lube (kPa/m) | DPDx (lube) (kPa/m) | % reduction |
|---|---|---|---|---|---|---|
| 0.20 | 24.91 | 1.40 | 5.62 | 2.99 | 2.60 | 13.04 |
| 0.39 | 48.28 | 1.40 | 2.90 | 3.38 | 3.12 | 7.69 |
| 0.61 | 75.84 | 1.40 | 1.85 | 3.69 | 3.69 | 0.00 |
| 0.87 | 108.18 | 1.40 | 1.29 | 3.96 | 3.96 | 0.00 |

TABLE 2

4-Hole Injection Results - Downstream Pipe

| U (m/s) | Qslurry (L/min) | Q lube (L/min) | % lube flow | DPDx (no lube) (kPa/m) | DPDx (lube) (kPa/m) | % reduction |
|---|---|---|---|---|---|---|
| 0.20 | 24.91 | 1.40 | 5.62 | 3.08 | 2.52 | 18.05 |
| 0.39 | 48.28 | 1.40 | 2.90 | 3.60 | 3.25 | 9.72 |
| 0.61 | 75.84 | 1.40 | 1.85 | 4.00 | 3.75 | 6.25 |
| 0.87 | 108.18 | 1.40 | 1.29 | 4.35 | 4.20 | 3.45 |

TABLE 3

Porous Results 1: Injection Section

| U (m/s) | Qslurry (L/min) | Q lube (L/min) | % lube flow | DPDx (no lube) (kPa/m) | DPDx (lube) (kPa/m) | % reduction |
|---|---|---|---|---|---|---|
| 0.24 | 29.75 | 1.20 | 4.03 | 3.52 | 2.07 | 41.18 |
| 0.49 | 61.08 | 1.20 | 1.96 | 4.07 | 2.07 | 49.15 |
| 0.90 | 113.40 | 1.00 | 0.88 | 4.34 | 1.90 | 56.35 |

TABLE 4

Porous Results 1: Downstream Pipe

| U (m/s) | Qslurry (L/min) | Q lube (L/min) | % lube flow | DPDx (no lube) (kPa/m) | DPDx (lube) (kPa/m) | % reduction |
|---|---|---|---|---|---|---|
| 0.24 | 29.75 | 1.20 | 4.03 | 2.98 | 0.75 | 74.79 |
| 0.49 | 61.08 | 1.20 | 1.96 | 3.43 | 0.73 | 78.83 |
| 0.90 | 113.40 | 1.00 | 0.88 | 3.95 | 2.53 | 36.08 |

TABLE 5

Porous Results 2: Injection Section

| U (m/s) | Qslurry (L/min) | Q lube (L/min) | % lube flow | DPDx (no lube) (kPa/m) | DPDx (lube) (kPa/m) | % reduction |
|---|---|---|---|---|---|---|
| 0.28 | 35.16 | 0.40 | 1.14 | 3.62 | 2.17 | 40.00 |
| 0.49 | 60.78 | 0.40 | 0.66 | 3.90 | 2.24 | 42.48 |
| 0.70 | 87.54 | 0.40 | 0.46 | 4.07 | 2.24 | 44.92 |
| 0.93 | 115.86 | 0.40 | 0.35 | 4.34 | 2.31 | 46.83 |
| 0.31 | 39.34 | 0.20 | 0.51 | 3.62 | 2.41 | 33.33 |
| 0.51 | 63.78 | 0.20 | 0.31 | 3.72 | 2.59 | 30.56 |

TABLE 5-continued

Porous Results 2: Injection Section

| U (m/s) | Qslurry (L/min) | Q lube (L/min) | % lube flow | DPDx (no lube) (kPa/m) | DPDx (lube) (kPa/m) | % reduction |
|---|---|---|---|---|---|---|
| 0.74 | 92.22 | 0.20 | 0.22 | 4.03 | 2.76 | 31.62 |
| 0.97 | 121.08 | 0.20 | 0.17 | 4.28 | 2.76 | 35.48 |
| 1.22 | 152.10 | 0.20 | 0.13 | 4.48 | 2.86 | 36.15 |

TABLE 6

Porous Results 2 - Downstream Pipe

| U (m/s) | Qslurry (L/min) | Q lube (L/min) | % lube flow | DPDx (no lube) (kPa/m) | DPDx (lube) (kPa/m) | % reduction |
|---|---|---|---|---|---|---|
| 0.28 | 35.16 | 0.40 | 1.14 | 3.03 | 0.74 | 75.58 |
| 0.49 | 60.78 | 0.40 | 0.66 | 3.33 | 1.71 | 48.65 |
| 0.70 | 87.54 | 0.40 | 0.46 | 3.60 | 2.70 | 25.03 |
| 0.93 | 115.86 | 0.40 | 0.35 | 3.90 | 3.24 | 16.82 |
| 0.31 | 39.34 | 0.20 | 0.51 | 2.98 | 2.05 | 31.09 |
| 0.51 | 63.78 | 0.20 | 0.31 | 3.25 | 2.78 | 14.46 |
| 0.74 | 92.22 | 0.20 | 0.22 | 3.60 | 3.14 | 12.80 |
| 0.97 | 121.08 | 0.20 | 0.17 | 3.90 | 3.45 | 11.54 |
| 1.22 | 152.10 | 0.20 | 0.13 | 4.10 | 3.80 | 7.32 |

TABLE 7

Porous Results 3 - Injection Section

| U (m/s) | Qslurry (L/min) | Q lube (L/min) | % lube flow | DPDx no lube (kPa/m) | DPDx (lube) (kPa/m) | % reduction |
|---|---|---|---|---|---|---|
| 0.33 | 41.11 | 0.20 | 0.49 | 3.28 | 1.83 | 44.21 |
| 0.56 | 69.84 | 0.20 | 0.29 | 3.38 | 2.10 | 37.76 |
| 0.79 | 98.58 | 0.15 | 0.15 | 3.55 | 2.48 | 30.10 |
| 1.03 | 129.06 | 0.13 | 0.10 | 3.79 | 2.72 | 28.18 |
| 1.27 | 158.28 | 0.10 | 0.06 | 4.07 | 3.10 | 23.73 |
| 1.52 | 190.50 | 0.10 | 0.05 | 4.52 | 3.31 | 26.72 |
| 1.77 | 221.28 | 0.10 | 0.05 | 4.76 | 3.55 | 25.36 |

TABLE 8

Porous Results 3 - Downstream Pipe

| U (m/s) | Qslurry (L/min) | Q lube (L/min) | % lube flow | DPDx no lube (kPa/m) | DPDx (lube) (kPa/m) | % reduction |
|---|---|---|---|---|---|---|
| 0.33 | 41.11 | 0.20 | 0.49 | 3.05 | 1.93 | 36.78 |
| 0.56 | 69.84 | 0.20 | 0.29 | 3.28 | 2.90 | 11.60 |
| 0.79 | 98.58 | 0.15 | 0.15 | 3.58 | 3.31 | 7.68 |
| 1.03 | 129.06 | 0.13 | 0.10 | 3.88 | 3.59 | 7.47 |
| 1.27 | 158.28 | 0.10 | 0.06 | 4.12 | 3.93 | 4.73 |
| 1.52 | 190.50 | 0.10 | 0.05 | 4.37 | 4.21 | 3.78 |
| 1.77 | 221.28 | 0.10 | 0.05 | 4.55 | 4.41 | 3.19 |

Embodiments have been described herein by way of example and with reference to illustrative arrangements, methods and infrastructure. These embodiments are not intended to be limiting. Rather, it is contemplated that some embodiments may be subject to variation or modification without departing from the spirit and scope of the described embodiments.

Throughout this specification and claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

What is claimed is:

1. A method for improving flow of a viscous fluid having a first viscosity in a fluid transport conduit having an upstream section and a downstream section, the method comprising:

providing a device comprising a porous conduit defining a passage through which the viscous fluid may pass between upstream and downstream sections of the fluid transport conduit and a casing member having a wall received around the porous conduit;

locating the device at at least one position along the fluid transport conduit between the upstream and downstream sections, the device being configured such that, when it is in situ, a fluid transfer chamber having at least one fluid inlet is defined between the casing member wall and the porous conduit;

providing a liquid having a second viscosity less than the first viscosity, wherein the liquid comprises an anti-scale reagent; and passing under pressure a flow of said liquid from the fluid transfer chamber through the porous conduit into the passage through which the viscous fluid passes, thereby forming a barrier which lines an inner surface of the fluid transport conduit to inhibit scaling.

2. The method according to claim 1, wherein the liquid is filtered before it passes through the porous conduit.

3. The method according to claim 1, wherein the liquid incorporates a viscosity modifier.

4. The method according to claim 1, wherein said at least one position comprises a plurality of positions which are spaced apart along the fluid transport conduit.

5. The method according to claim 1, wherein the viscous fluid comprises a slurry.

6. The method according to claim 1, wherein the liquid further contains a corrosion inhibitor.

7. The method according to claim 2, wherein the liquid is filtered through a porous material having a smaller average pore size than an average pore size of the porous conduit.

8. The method according to claim 1, wherein said at least one position comprises a plurality of positions which are spaced apart along the fluid transport conduit.

9. The method according to claim 1, wherein the porous conduit is formed of a sintered or compressed material.

10. The method according to claim 9, wherein the porous conduit is formed of sintered bronze and has an average pore size of 2 to 500 microns such that it has a voidage of 20% to 50%.

11. The method according to claim 9, wherein the porous conduit is formed of sintered stainless steel and has an average pore size of 0.2 to 100 microns such that it has a voidage of 20% to 50%.

12. The method according to claim 1, wherein the porous conduit has an average pore size of 20 microns.

13. The method according to claim 1, wherein the porous conduit has an average pore size of 10 microns.

14. The method according to claim 1, wherein the barrier comprises a film or layer of the liquid along an inner surface of the fluid transport conduit to reduce physical contact between the viscous fluid and the fluid transport conduit.

15. The method according to claim 1, wherein the liquid is distributed substantially evenly around the inner surface of the fluid transport conduit.

* * * * *